US006799509B2

(12) United States Patent
Naniwa

(10) Patent No.: US 6,799,509 B2
(45) Date of Patent: Oct. 5, 2004

(54) INK-FURNISHING APPARATUS, PRINTING MACHINE THEREWITH AND PRINTING METHOD

(75) Inventor: Mutsumi Naniwa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/211,374

(22) Filed: Aug. 5, 2002

(65) Prior Publication Data

US 2003/0024425 A1 Feb. 6, 2003

(30) Foreign Application Priority Data

Aug. 6, 2001 (JP) ..... P. 2001-238037
Sep. 6, 2001 (JP) ..... P. 2001-270453
Jul. 23, 2002 (JP) ..... P. 2002-214065

(51) Int. Cl.[7] ..... B41F 31/02
(52) U.S. Cl. ..... 101/365; 101/350.1
(58) Field of Search ..... 101/350.1, 350.2, 101/365, 485, 366, 367

(56) References Cited

U.S. PATENT DOCUMENTS 1,736,941 A 11/1929 Schroeder
2,056,210 A 10/1936 Rowell
4,041,864 A 8/1977 Dahlgren et al.
4,211,167 A * 7/1980 Corse ..... 101/365
4,480,547 A * 11/1984 Jeschke et al. ..... 101/365
4,542,693 A * 9/1985 Mourrellone ..... 101/365
4,773,327 A * 9/1988 Moetteli ..... 101/365
4,960,052 A * 10/1990 Junghans ..... 101/365
5,967,049 A * 10/1999 Seymour et al. ..... 101/365
6,178,887 B1 * 1/2001 Hachiya et al. ..... 101/351.2
6,584,901 B1 * 7/2003 Sarda ..... 101/350.1

FOREIGN PATENT DOCUMENTS

| | | |
|---|---|---|
| EP | 0 546 454 | 12/1992 |
| EP | 0 551 834 | 1/1993 |
| JP | 53-36308 | 4/1978 |
| JP | 55-7453 | 1/1980 |
| JP | 58-45955 | 3/1983 |
| JP | 58-65663 | 4/1983 |
| JP | 58-84771 | 5/1983 |

OTHER PUBLICATIONS

Anonymous: :Agitator for Thixotropic Ink; Jan. 1972; IBM Technical Disclosure Bulletin; vol. 14; No. 8; Jan. 1, 1972; p. 2468; XP002221326; New York.

* cited by examiner

*Primary Examiner*—Eugene H. Eickholt
(74) *Attorney, Agent, or Firm*—Sughrue Mion, PLLC

(57) ABSTRACT

An ink furnishing apparatus comprises an ink fountain storing ink, an ink furnishing roller engaged with the ink fountain, withdrawing the ink in the ink fountain by rotations thereof and furnishing the ink to a printing plate, and an ink contacting member formed at substantially an entire length of the ink fountain in a width direction thereof and contactable with the ink in the ink fountain.

20 Claims, 11 Drawing Sheets

View taken from the arrow Y

View taken from the arrow Z

View taken from the arrow Y

~~X矢視~~ View taken from the arrow X

INK-FURNISHING APPARATUS, PRINTING MACHINE THEREWITH AND PRINTING METHOD

BACKGROUND OF THE INVENTION

The present invention relates to an ink-furnishing apparatus, which furnishes ink stored in an ink fountain to an ink furnishing roller that is brought into contact with a plate cylinder, and an offset printing method using the same ink-furnishing apparatus.

FIG. 20 shows a general construction of a prior art ink-furnishing apparatus for an offset press. Ink stored in an ink reservoir is led to an ink transfer roller 904 side by rotations of an ink furnishing roller 903. By causing the ink transfer roller 904 to alternately be brought into contact with the ink furnishing roller 903 and the top roller of a group of ink mixing rollers 905, an ink membrane formed on the surface of the ink furnishing roller 903 is transferred onto respective rollers of the group of ink mixing rollers 905 one after another, and is fed onto the surface of a plate cylinder 901 via an ink application roller 902. Further, an aqueous membrane is formed on the surface of a non-imaged portion of the plate cylinder 901 by a dampening device 506, wherein no ink is transferred onto the non-imaged portions.

Since the above-described offset press ink is intermittently fed by swinging of the ink transfer roller, it is necessary that a uniform membrane of ink is formed while gradually transferring ink by a number of rollers of the group of ink mixing rollers, and the uniform membrane of ink is fed onto the surface of the plate cylinder. Therefore, the apparatus is complicated and large-sized, resulting in maintenance difficulty and an increase in production costs.

In order to solve the above-described problem incidental to intermittent furnishing of ink, offset presses disclosed by Japanese Unexamined Patent Application Publication Nos. 58-45955, 58-65663, and 58-84771 have been publicly known. In either of these offset presses, continuous furnishing of ink is employed, thereby removing a group of ink mixing rollers, wherein the apparatus is simplified and small-sized, maintenance thereof is facilitated, and production costs thereof are decreased.

However, since no group of ink mixing rollers is provided, an ink reservoir is located in the vicinity of a dampening device, wherein ink is remarkably emulsified to worsen the printing density, that is, so-called "emulsification" occurs. Also, a dampening water is likely to be mixed in the ink reservoir. In the worst case, roller stripping occurs, for which the ink is not permitted to be applied onto the ink furnishing roller better, and there occurs a possibility for ink not to be measured and fed. In order to avoid this roller stripping, accurate adjustment of the dampening water device is indispensable. However, the stabilized area thereof is very narrow, and there may be a case where the adjustment is disabled, depending upon specified combinations of ink to be used and the dampening water.

An offset press disclosed by Japanese Unexamined Patent Application Publication No. 55-7453 has been publicly known as such a type that can solve the above-described problems resulting from the dampening water. The offset press does not require the furnishing of the dampening water by employing emulsion ink (which is a colloid in which ink and an aqueous constituent are blended) as ink, wherein it is possible to prevent a roller stripping phenomenon from occurring, and no dampening water device is required. Further, it is possible to simplify and make the apparatus small, and to simplify maintenance and to decrease production costs.

In offset printing for which emulsion ink is used, it is necessary to break emulsion in order to divide the emulsion ink into ink constituents and aqueous constituents at the stage where the emulsion ink is transferred onto the ink application roller that is in contact with the plate cylinder.

Conventionally, some types have been publicly known as unit for breaking emulsion. One of the types (Japanese Unexamined Patent Application Publication No. 53-36308) is such that emulsion of emulsion ink is broken by actions of cooling unit and shearing force applying unit, which are provided at an ink application roller in an ink-furnishing apparatus, and another one thereof (Japanese Unexamined Patent Application No. 55-7453) is such that emulsion is broken by cooling and with an intensive shearing force brought about by an ink application roller in an ink-furnishing apparatus and an adjusting roller whose surface is hydrophilic.

Where an offset press is used, in which ink is continuously fed and emulsion ink is used, since the ink furnishing roller continuously rotates and the rotation speed thereof is comparatively fast, a rod-like ink clump (see FIG. 21, this is referred to as an "ink roll") may be formed in parallel to the axial direction of the ink furnishing roller in an ink reservoir. If an ink roll is generated, fluidity and agitation of ink in the ink reservoir is hindered, ink existing in a comparatively surface layer of the ink roll is only consumed without being replaced by ink inside the ink roll. Therefore, in the case of a two-constituent blended liquid of ink and an aqueous constituent such as emulsion ink, balance between the ink and the aqueous constituent of emulsion ink, which is measured and fed to the ink application roller, is varied to adversely influence the printing performance (in particular, smirching resistance).

In order to break down the above-described emulsion, it is necessary that emulsion ink is cooled down and a shearing force is applied thereto. However, ink becomes remarkably hard due to a lowering in ink temperature (generally called "ink condensing"), wherein it becomes difficult to transfer ink, thereby causing such a problem of printing drawbacks such as shortage in density, whiteout, etc. Therefore, it is not desired that cooling is preferentially used as unit for breaking down emulsion, Also, for application of a shearing force, ink has been subjected to slipping between rollers. However, since stability of emulsion is increased due to an increase in ink temperature resulting from friction by slipping between rollers, it becomes difficult for the emulsion to be broken down. Therefore, the relationship between a slipping amount and an effect to break down emulsion is not proportionate, wherein the effect of breaking down emulsion is limited even if the slipping amount is increased, and a sufficient effect of emulsion breakage cannot be obtained. Furthermore, the cohesion power of ink is lowered in line with an increase in ink temperature, wherein such a problem arises in that printing drawbacks such as ink fill-in and scumming, etc., occur.

Although an increase in ink temperature due to slipping between the above-described rollers can be suppressed by concurrently employing the above-described cooling unit, it becomes necessary to prepare cooling unit whose cooling output is large since the heat generation amount due to slipping is large.

In addition, the method for slipping between rollers results in remarkable wearing of the rollers. Further, such a problem arises in that, if an offset press is operated with no ink provided by mistake, the roller will be instantaneously damaged.

SUMMARY OF THE INVENTION

The present invention was developed in view of the above-described situations. It is therefore a first object of the present invention to provide an ink-furnishing apparatus that is able to suppress or prevent ink rolls from occurring in an ink reservoir, secure satisfactory fluidity and agitation of ink in the ink reservoir, and carry out smooth measuring of ink and furnishing thereof to an ink furnishing roller, and an offset printing method using the same.

The present invention was developed in view of the above-described and other problems, and it is therefore a second object of the present invention to provide an ink-furnishing apparatus and an offset printing method, which are able to apply an effective shearing force in order to break down emulsion, can be easily controlled during operations, where an increase in ink temperature and wearing of rollers are only slight, and there is little possibility for the rollers to be damaged.

In order to solve the objects, according to a first aspect of the present invention, there is provided an ink furnishing apparatus comprising: an ink fountain storing ink; an ink furnishing roller engaged with the ink fountain, withdrawing the ink in the ink fountain by rotations thereof and furnishing the ink to a printing plate; and an ink contacting member formed at substantially an entire length of the ink fountain in a width direction thereof and contactable with the ink in the ink fountain.

According to a second aspect of the present invention, there is provided an ink furnishing apparatus as set forth in the first aspect of the present invention, wherein the ink contacting member is disposed to be spaced from the ink furnishing roller.

According to a third aspect of the present invention, there is provided an ink furnishing apparatus as set forth in the first or second aspect of the present invention, wherein the ink contacting member is disposed substantially in parallel to an axial line of the ink furnishing roller.

According to a fourth aspect of the present invention, there is provided an ink furnishing apparatus as set forth in any one of the first to third aspects of the present invention, wherein the ink contacting member is divided into a plurality of sections along the width direction of the ink fountain, or includes a plurality of molded members juxtaposed along the width direction of the ink fountain.

According to a fifth aspect of the present invention, there is provided an ink furnishing apparatus as set forth in any one of the first to fourth aspects of the present invention, wherein the portion of the ink contacting member, wherein a portion of the ink contacting member contacting with the ink inclined with respect to an axial line of the ink furnishing roller.

According to a sixth aspect of the present invention, there is provided an ink furnishing apparatus as set forth in any one of the first to fifth aspects of the present invention, wherein the ink contacting member includes a baffle plate or roller.

According to a seventh aspect of the present invention, there is provided an ink furnishing apparatus as set forth in any one of the first to sixth aspects of the present invention, wherein a surface of the ink contacting member defines grooves thereon, or a surface of the ink contacting member defines inclined grooves thereon with respect to the axial line of the ink furnishing roller.

According to an eighth aspect of the present invention, there is provided an ink furnishing apparatus as set forth in any one of the first to seventh aspects of the present invention, wherein the ink contacting member includes a drive unit for moving or rotating the ink contacting member.

In addition, according to the above construction, it is preferable that there is provided a printing machine with the above ink furnishing apparatus.

According to the above-described construction, since ink contacting member is provided, it is possible to suppress or prevent ink rolls from being formed in the ink fountain, wherein ink fluidity and agitation ability of ink in the ink fountain can be secured, and favorable ink metering and furnishing to an ink forming roller are enabled.

In order to solve the objects, according to a ninth aspect of the present invention, there is provided an ink-furnishing apparatus comprising: an ink fountain storing emulsion ink therein; an ink forming roller contacting with a printing plate and furnishing the emulsion ink to the printing plate; a shear controlling roller contacting with the ink furnishing roller and bringing about emulsion breakage by applying shear to the emulsion ink; and a nip pressure controlling unit controllable a nip pressure at a contact point between the shear controlling roller and the ink forming roller during operation.

According to a tenth aspect of the present invention, there is provided an ink-furnishing apparatus as set forth in the ninth aspect of the present invention, further comprising: an ink furnishing roller furnishing the emulsion ink to the ink forming roller; and an ink furnishing unit withdrawing the emulsion ink with a predetermined membrane thickness from the ink fountain in cooperation with the ink furnishing roller and forming the emulsion ink on the surface of the ink furnishing roller.

According to an eleventh aspect of the present invention, there is provided an ink-furnishing apparatus as set forth in the ninth aspect of the present invention, further comprising an ink furnishing unit withdrawing the emulsion ink with a predetermined membrane thickness from the ink fountain in cooperation with the ink forming roller and forming the emulsion ink on the surface of the ink forming roller.

According to a twelfth aspect of the present invention, there is provided an ink-furnishing apparatus as set forth in any one of the ninth to eleventh aspects of the present invention, wherein unit for agitating the emulsion ink is fed in the ink fountain.

According to the present invention, there is provided a printing method comprising steps of: furnishing emulsion ink stored in an ink fountain to an ink forming roller contacting with a printing plate of an offset press; contacting a shear controlling roller onto the emulsion ink on the ink forming roller; controlling a nip pressure at a contact point between the ink forming roller and the shear controlling roller; applying a shear to the emulsion ink by the shear controlling roller, the shear bringing about emulsion breakage at the contact point; and furnishing emulsion ink on the ink forming roller to the printing plate while maintaining appointed emulsion breakage of the emulsion ink. Also, it is preferable that, while adding an agitation effect in the axial direction of the ink furnishing roller for furnishing emulsion ink to the above-described ink furnishing roller with respect to ink stored in the above-described ink fountain, ink is fed to the above-described ink furnishing roller.

According to the ink-furnishing apparatus according to the ninth to twelfth aspects and offset printing method according to the thirteenth aspect, since the nip pressure controlling unit that is able to control the nip pressure of the shear controlling roller to break down emulsion during operations is provided, it is possible to apply an effective shearing force to break down emulsion by re-adjusting the nip pressure without stopping the operations even in a case where the shear fluctuates during the operation and the printing quality is adversely influenced.

Since the apparatus according to the twelfth aspect is provided with ink agitating unit in the ink fountain, ink rolls (rod-like ink clump parallel to the axial direction of the ink furnishing roller) formed in the ink fountain can be prevented from being generated. Therefore, it is possible to secure fluidity and agitation of ink in the ink fountain, wherein it becomes possible to satisfactorily measure and furnish ink to the ink furnishing roller. In an offset press employing emulsion ink, generally, ink rolls are likely to occur in the ink fountain due to continuous furnishing of ink and high-speed rotations of the ink furnishing roller. According to information of the present inventor, it is confirmed that ink rolls are generated at a roller speed of several hundred millimeters per second or more. Ink existing in a comparatively surface layer of ink rolls is consumed without being replaced with ink inside the ink rolls, wherein, with a two-constituent mixture liquid such as emulsion ink, balance of ink to an aqueous constituent, which are measured and fed to the ink furnishing roller is changed due to generation of ink rolls, and a lowering in the printing quality is remarkable in comparison with a case where normal ink is used. Therefore, since fluidity and agitation of ink in an ink fountain are secured by providing ink agitating unit, the constituent balance of the emulsion ink is not broken up, wherein satisfactory furnishing of ink to the ink furnishing roller can be brought about.

DESCRIPTION OF THE PREFERRED EMBODIMENTS

Hereinafter, a description is given of a rough construction of an ink furnishing apparatus according to the present invention on the basis of FIG. 1.

Figure 1:
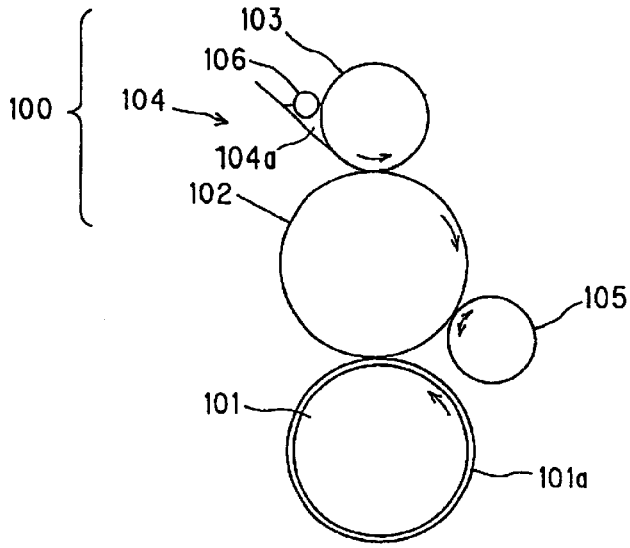
FIG. 1 is a view showing a rough construction of an ink furnishing apparatus according to a first embodiment of the present invention.

As shown in FIG. 1, the ink furnishing apparatus 100 includes an ink forming roller 102 that furnishes ink to a printing plate 101*a* attached to a plate cylinder 101 of a press, an ink furnishing roller 103 that furnishes ink to the ink forming roller 102, and an ink fountain 104*a* that stores ink, and is further provided with ink metering and furnishing unit 104 that takes out (meters) emulsion ink in the ink fountain 104*a* onto the ink furnishing roller 103 at a roughly predetermined membrane thickness in collaboration with rotation movements of the above-described ink furnishing roller 103. Also, in the present embodiment, water-in-oil type (W/O type) emulsion ink is reserved and stored in the above-described ink fountain 104*a*.

A shear control roller 105 is added to the ink forming roller 102 as emulsion breaking unit that controls an emulsion state of the emulsion ink on the ink forming roller 102. The shear control roller 105 is brought into contact with the ink forming roller 102 and rotates at an optional speed in an optional direction, thereby providing shear (a shearing force) to emulsion ink supplied onto the ink forming roller 102, and the shear control roller 105 controls the emulsion state of emulsion ink, that is, the balance in constituents with respect to aqueous constituents and ink constituents. Described in detail, the shear control roller 105 adds shear (a shearing force) to the emulsion ink by causing the shear control roller 105 to slip at the contacting point with the ink forming roller 102, wherein emulsion breakage is caused to occur in the emulsion ink in order to separate aqueous constituents. In addition, the material of the shear control roller 105 is not particularly limited.

An ink contacting member 106 that is formed along roughly the entire length in the width direction of the ink fountain 104*a* and is brought into contact with emulsion ink reversed and stored in the ink fountain 104*a* is disposed in the ink fountain 104*a* or upward of the ink fountain 104*a*. At least a part of the ink contacting member 106 is brought into contact with emulsion ink in the ink fountain 104*a* and changes the convection state of the emulsion ink in the ink fountain 104*a*. In other words, the ink contacting member 106 functions as a resistor with respect to ink rolls or functions as agitating unit that changes the convection state of emulsion ink in the ink fountain 104*a*.

Hereinafter, a description is given of actions of ink furnishing of the above-described ink furnishing apparatus 100.

In the ink furnishing apparatus 100, emulsion ink in the ink fountain 104*a* is fed from the ink furnishing roller to the ink forming roller 102 after it is withdrawn (metered) onto the ink furnishing roller 103 at a roughly predetermined membrane thickness by rotation movements of the ink furnishing roller 103 and the ink metering and furnishing unit 104.

And, the emulsion state, that is, the constituent balance of aqueous constituents and ink constituents, of the emulsion ink fed onto the ink forming roller 102 is controlled by shear applied by the shear control roller 105. Described in detail, where shear is applied to water-in-oil type (W/O type) emulsion ink as described above, a part of the aqueous constituents of the emulsion ink is separated.

And, the emulsion ink, whose balance of the aqueous constituents/ink constituents has been controlled on the ink forming roller 102 as described above, is fed onto a printing plate 102*a* attached on a plate cylinder 101 of a press, whereby offset printing (lithography) is carried out.

Herein, in the present invention, since an ink contacting member 106 is disposed, a convection state of the emulsion ink in the ink fountain 104*a* can be changed, and resultantly, agitation ability in the ink fountain 104*a* can be improved. Thereby, it is possible to suppress or prevent ink rolls from occurring in the ink fountain 104*a*. In addition, since it is possible to furnish the emulsion ink having a stable balance of the aqueous constituents/ink constituents to the ink furnishing roller 103 and ink forming roller 102, a stable printing can be achieved without smirching.

Hereinafter, a description is given of a preferred embodiment of an ink furnishing apparatus 100 according to the present invention, focusing on the ink-contacting member 106.

Embodiment 1

Figure 2:
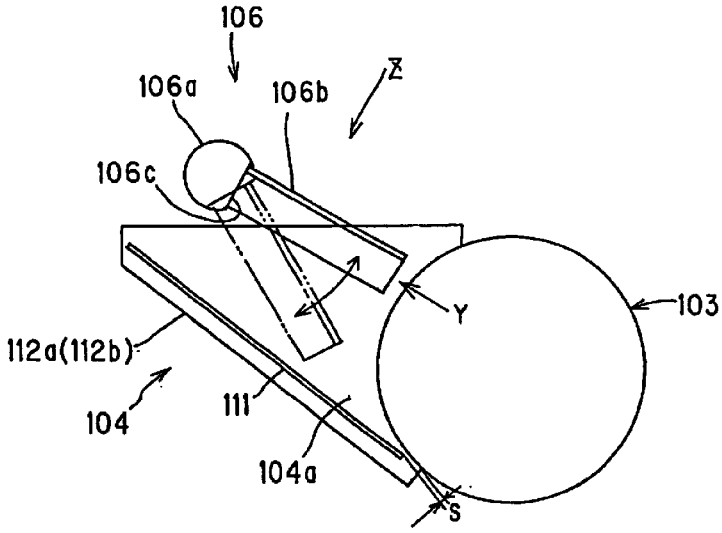
FIG. 2 is a view showing the first embodiment of the ink furnishing apparatus.
Figure 3:
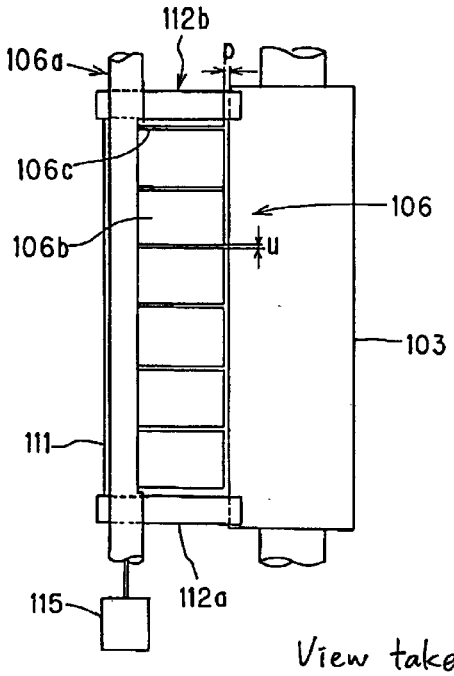
FIG. 3 is a view, taken along the arrow Z, of the ink furnishing apparatus shown in FIG. 2.
Figure 4:
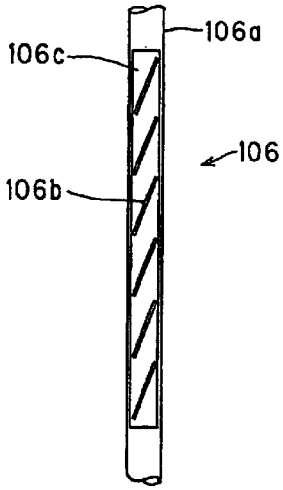
FIG. 4 is a view, taken along the arrow Y, of the ink furnishing apparatus shown in FIG. 2.

FIG. 2 through FIG. 4 show a first embodiment of the ink furnishing apparatus 100 according to the present invention. In the first embodiment, the ink metering and furnishing unit 104 is provided with a blade 111 acting as a bottom plate, and a pair of end sealing plates 112*a* and 112*b* acting as side plates. By engaging the blade 111 and end sealing plates 112*a* and 112*b* with the ink furnishing roller 103 as described in the drawings, the above-described ink fountain 104*a* is formed. That is, the blade 111 and ink furnishing roller 103 are, respectively, disposed at positions spaced from each other with fixed clearance S, wherein emulsion ink in the ink fountain 104*a* can be withdrawn to the ink furnishing roller 103 at a roughly predetermined membrane thickness through the clearance S.

As shown in FIG. 2 and FIG. 3, the ink contacting member 106 according to the embodiment is disposed upward of the ink fountain 104*a*. The ink contacting member 106 is disposed in roughly parallel to the axial line of the ink furnishing roller 103, and at the same time, is disposed at a position spaced from the ink furnishing roller 103 by an appointed distance D, that is, at a position spaced from the ink furnishing roller 103.

The ink contacting member 106 is provided with an axial member 106*a* pivotally supported at a press (not illustrated) and a plurality of plate members 106*b* (six plates in the illustration) acting as baffle plates. The axial member 106*a* has a plane 106*c*, and the above-described plate members 106*b* are juxtaposed on the plane 106*c* with parallel established spacing U. Therefore, in the ink contacting member 106, the plate members 106*b* are formed along roughly the entire length in the width direction of the ink fountain 104*a* (See FIG. 3). Also, as has been made clear with reference to FIG. 4, the respective plate members 106*b* are, respectively, disposed so as to be inclined in the axial direction of the axial member 106*a*. Accordingly, in view of the relationship between the respective plate members 106*b* and the ink furnishing roller 103, the respective plate members 106*b* are, respectively, disposed so as to be inclined with respect to the axial line of the ink furnishing roller 103.

Driving unit 115 such as an electric motor, etc., is added to the ink contacting member 106. The ink contacting member 106 is continuously or stepwise rotatable centering around the axial member 106*a* by the driving unit 115. Therefore, since the position of the ink contacting member 106 optionally moves, whereby it is possible to optionally set the degree of contacting of the plate member 106*b* with respect to emulsion ink in the ink fountain 104*a*.

With the ink furnishing apparatus 100 according to the embodiment, the ink contacting member 106 (plate members 106*b*) is brought into contact with emulsion ink in the ink fountain 104*a* along roughly the entire length in the width direction of the ink fountain 104*a*. Accordingly, the convection state of the emulsion ink in the ink fountain 104*a* can be varied, and resultantly, since agitation ability in the ink fountain 104*a* can be improved, it is possible to suppress or prevent ink rolls from occurring in the ink fountain 104*a*, wherein favorable metering and furnishing of ink to the ink forming roller 102 can be achieved.

Also, since the ink contacting member 106 (plate members 106*b*) is disposed so as to be spaced from the ink furnishing roller 103, emulsion breakdown in the ink fountain 104*a* can be suppressed, wherein more stabilized metering and furnishing of ink can be carried out. In this case, in view of securing stabilized metering and furnishing of ink, it is preferable that the distance D between the ink contacting member 106 (plate members 106*b*) and the ink furnishing roller 103 is 1 through 10 mm, and it is further preferable that the distance D is 1 through 5 mm.

Further, it does not matter that the ink-contacting member 106 is disposed in a contact condition with the ink furnishing roller 103. In other words, the ink contacting member 106 may be disposed in a range where an ink roll will be rolled, or at a position where a convection state of emulsion ink in the ink fountain 104*a* can be varied.

In addition, since the ink contacting member 106 is disposed roughly in parallel to the axial line of the ink furnishing roller 103, an action of improving agitation ability by varying the convection state of emulsion ink in the ink fountain 104*a* can be uniformly brought about along the width direction of the ink fountain 104*a*.

Also, since the ink contacting member 106 is constructed by juxtaposing the plate members 106*b* on the plane 106*c* of the axial member 106*a* with parallel established spacing U, it is possible to further improve the fluidity of emulsion ink in the ink fountain 104*a* through the spacing U between the plate members 106*b*. Therefore, agitation ability in the ink fountain 104*a* can be further accelerated, wherein it is possible to further effectively suppress or prevent ink rolls from occurring in the ink fountain 104*a*.

Herein, the spacing U between the respective plate members 106*b* is not particularly limited, but may be adequately determined in compliance with the type and characteristics of the emulsion ink used, and rotation speed of the ink furnishing roller 103. However, it is preferable that the spacing U is 30 mm or less, further preferable that the spacing U is 20 mm or less, and particularly preferable that the spacing U is 10 mm or less.

By disposing the plate members 106*b* of the ink contacting member 106 so as to be inclined with respect to the axial line of the ink furnishing roller 103, it is possible to remarkably improve the convection state of emulsion ink in the ink fountain 104*a*, particularly the convection states in the width direction of the ink fountain 104*a*, and favorable metering and furnishing of emulsion ink to the ink forming roller 102 can be achieved.

In addition, in the ink contacting member 106 illustrated, although the axial member 106*a* and a plurality of plate members 106*b* are separately composed, these maybe integrally composed. Also, a single plate member 106*b* whose length is roughly equivalent to the entire length of the ink fountain 104*a* in its width direction may be provided instead of a plurality of plate members 106*b*, and the single plate member 106*b* may be installed with respect to the axial member 106*a* in a state where the same is inclined with respect to the axial line of the ink furnishing roller 103. Further, such a member may be employed, in which, after the single plate member is provided with a plurality of notches, respective parts divided by the notches are threaded.

On the other hand, by causing the ink-contacting member 106 to rotate continuously or stepwise by the driving unit 115, emulsion ink in the ink fountain 104*a* can be agitated by design. In this case, further favorable metering and furnishing of ink to the ink forming roller 102 can be achieved.

Further, the ink contacting member 106 (plate members 106*b*) can be moved to an optional position by the driving unit 115, and it is possible to apply the same to various use conditions responsive to an increase or a decrease in the emulsion ink amount in the ink fountain 104*a*. Also, in this case, it is preferable that such a control mechanism may be employed, which can move the ink contacting member 106 (plate members 106*b*) to an adequate position by adding an ink amount detecting sensor that is able to detect the emulsion ink amount in the ink fountain 104*a*, and cause the axial member 106*a* to rotate on the basis of the result of the detection.

Also, the above-described ink furnishing apparatus 100 may be modified as necessary and employed.

The ink metering and furnishing unit 104 is not particularly limited. That is, publicly known unit may be applicable. Several types are available, for example, one of which is a type that adjusts the ink-furnishing amount by increasing or decreasing the clearance between the ink furnishing roller and the blade, another of which is a type that adjusts the ink-furnishing amount by raking surplus ink with a doctor blade slidingly brought into contact with the ink furnishing roller (anilox roller) having recess cells on its surface (anilox system), and still another of which is a type that adjusts the ink-furnishing amount by increasing or decreasing the clearance or nip pressure between an adjustment roller and the ink furnishing roller with the adjustment roller disposed.

It is preferable that the ink furnishing roller 103 and ink forming roller 102 have the same diameter in view of preventing printing obstacles such as stains, unevenness, defective printing resistance, etc., which result from slipping. On the other hand, in view of making the apparatus small, as shown in the drawings, it is preferable that the ink furnishing roller 103 is made smaller than the ink forming roller 102 in diameter.

In order to prevent a difference (ghost) in ink density due to unevenness in ink transfer onto a plate cylinder 101, it is preferable that the diameter of the ink forming roller 102 is made the same as that of the plate cylinder 101. However, it is not necessary that the diameter of the ink forming roller 102 is completely the same as that of the plate cylinder 101, wherein it is confirmed that the ghost resistance performance does not deteriorate if the diameter of the ink forming roller 102 is within approx. ±1 mm with respect to the diameter of the plate cylinder 101. Therefore, it is preferable that the ink forming roller 102 is made larger by approx. 1 mm than the diameter of the plate cylinder 101, taking into consideration wear on the surface of the ink form cylinder 102 as a result of use.

In addition, in order to prevent printing obstacles such as stains, unevenness, defective printing resistance, etc., which result from slipping, it is preferable that the plate cylinder 101 and ink forming roller 102 are driven to rotate at the same peripheral speed. Also, in such a case, since the rotation speed of the ink forming roller 102 changes due to influences due to slipping, which is produced between the ink forming roller 102 and the shear control roller 105, it is preferable that the peripheral speed is controlled so that no slip is produced between the plate cylinder 101 and the ink forming roller 102, taking the speed change into consideration.

In order to efficiently furnish aqueous constituents of emulsion ink, which are separated from the emulsion ink by breaking down the emulsion thereof, onto a printing plate 101*a* on the plate cylinder 101, it is preferable that the position where the shear control roller 105 is disposed with respect to the ink forming roller 102 is set to the upstream side from the contacting point between the ink forming roller 102 and the printing plate 101*a* on the plate cylinder 101 in the rotation direction of the ink forming roller 102. Further, it is further preferable that the position is closer to the contacting point between the ink forming roller 102 and the printing plate 101*a* on the plate cylinder 101.

Since a necessary slipping amount brought about by the shear control roller 105 varies in compliance with various conditions such as a plate material used, image area ratio, printing speed, environmental conditions, ink/aqueous constituent ratio of emulsion ink, stability of emulsion, and viscosity of emulsion ink, etc., the slipping amount may be adequately established in compliance with these conditions. Also, since these conditions change during printing, it is further preferable that unit for controlling the rotation speed of the shear control roller 105 is additionally provided.

Also, it is preferable that cooling unit is provided in order to prevent heat generation and temperature rise, which result from slipping between the shear control roller 105 and ink forming roller 102. Such publicly known cooling systems such as a type in which cooling water is circulated into the rollers, a type in which cold air is circulated into the rollers, etc., may be applied as this type of cooling unit.

In addition, in order to make the ink membrane uniform in the axial direction of the roller surface or to further increase the shearing effect, the shear control roller 105 may reciprocate in the axial direction of the roller.

Embodiment 2

Figure 5:
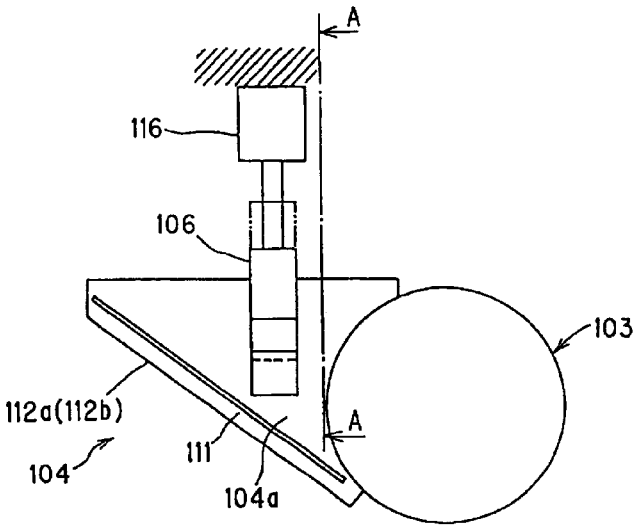
FIG. 5 is a view showing a second embodiment of the ink furnishing apparatus.
Figure 6:
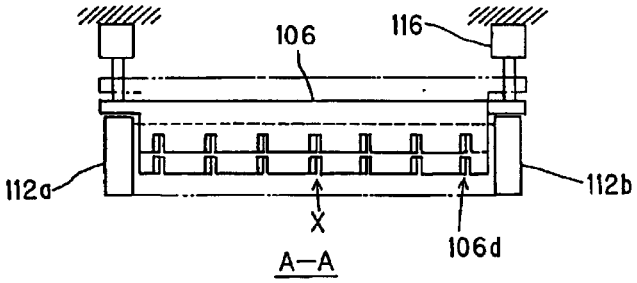
FIG. 6 is a sectional view taken along the line A—A of the ink furnishing apparatus shown in FIG. 5.
Figure 7:
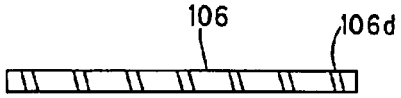
FIG. 7 is a view, taken along the arrow X, of the ink furnishing apparatus shown in FIG. 5.

FIG. 5 through FIG. 7 show a second embodiment of an ink furnishing apparatus according to the present invention. Also, since the second embodiment has the same construction as that of the above-described first embodiment, excepting that the construction of the ink contacting member 106 differs from that of the former embodiment, an overlapping description is omitted.

The ink contacting member 106 according to the present embodiment is composed of a single plate member that is formed roughly in the entire length of the ink fountain 104*a* in its width direction. A plurality of diagonal grooves 106*b* (seven grooves in the drawings), which are inclined with respect to the axial line of the ink furnishing roller 103, are formed at the end portion at the ink fountain 104*a* side of the ink contacting member 106.

The ink contacting member 106 which is disposed upward of the ink fountain 104*a*, is disposed roughly in parallel to the axial line of the ink furnishing roller 103, and, more specifically, is disposed at a position spaced by an appointed distance D from the ink furnishing roller 103, that is, at a position spaced from the ink furnishing roller 103.

Also, driving unit 116 such as an air cylinder, etc., is additionally provided at the ink contacting member 106, wherein the position of the ink contacting member 106 is moved continuously or stepwise in the vertical up and down directions. The driving unit 116 is not particularly limited. However, a type in which a motor and screws are combined, a publicly known type such as a solenoid may be applicable.

Even if the ink contacting member 106 is constructed as in the present embodiment, the same effects as those in the above-described first embodiment can be brought about.

In particular, by providing grooves on the surface of the ink-contacting member 106 composed of a single plate member, it is possible to improve the convection states of emulsion ink in the ink fountain 104*a*. Further, by providing diagonal grooves 106*d*, which are inclined with respect to the axial line of the ink furnishing roller 103, on the surface of the ink contacting member 106, fluidity in the width direction of the ink fountain 104*a* can be remarkably increased as in the above-described first embodiment, wherein further favorable metering and furnishing of ink onto the ink forming roller 102 can be achieved. Also, the angle and quantity of the diagonal grooves 106*d* are not particularly limited. These may be adequately established in compliance with use conditions such as printing speed, ink used, etc.

Further, by moving the ink contacting member 106 up and down continuously or stepwise by the driving unit 116, it is possible to agitate emulsion ink in the ink fountain 104*a* as in the above-described first embodiment, and at the same time, the ink contacting member 106 can be applied to various use conditions in response to an increase or decrease in the emulsion ink amount in the ink fountain 104*a*.

Embodiment 3

Figure 8:
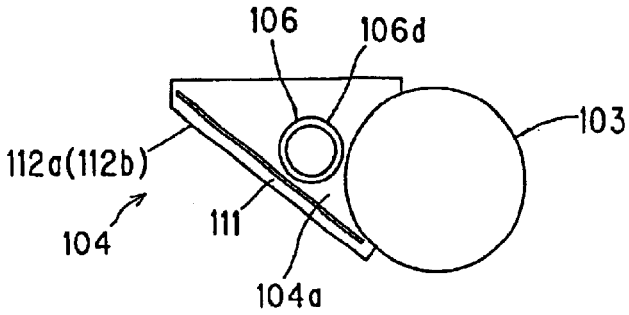
FIG. 8 is a view showing a third embodiment of the ink furnishing apparatus.
Figure 9:
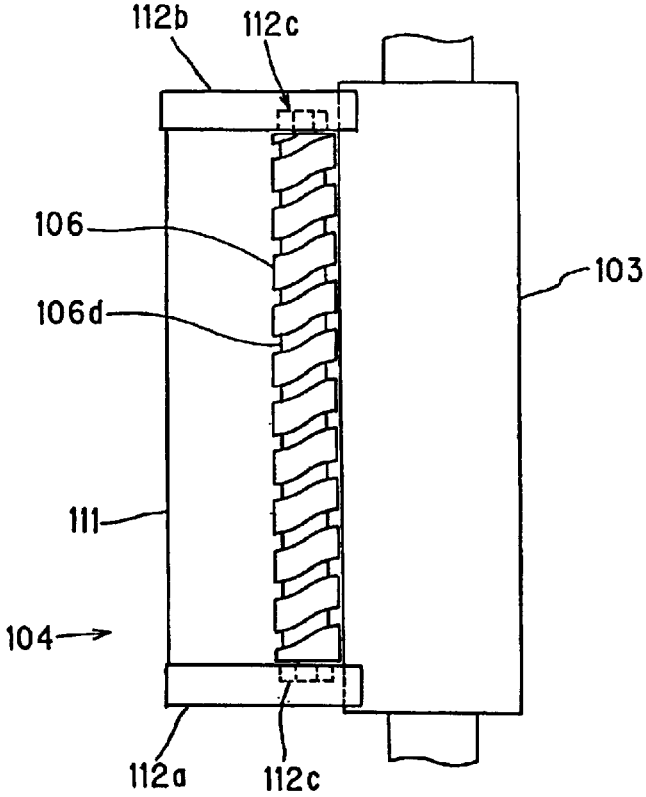
FIG. 9 is a view showing the third embodiment of the ink furnishing apparatus.

FIG. 8 and FIG. 9 show a third embodiment of the ink furnishing apparatus 100 according to the present invention. Also, since the second embodiment has the same construction as that of the above-described first embodiment, excepting that the construction and arrangement of the ink contacting member 106 differ from those of the former embodiment, an overlapping description is omitted.

The ink contacting member 106 according to the present embodiment is composed of a roller that is formed roughly over the entire length in the width direction of the ink fountain 104*a*. A spiral groove 106*d* that is inclined with respect to the axial line of the ink furnishing roller 103 is formed on the surface of the ink contacting member 106.

The ink contacting member 106 is disposed in the ink fountain 104*a* and is placed and fixed between bearings 112*c* secured at a pair of end sealing plates 112*a* and 112*b*. Therefore, a part or the entirety of the ink contacting member 106 according to the present embodiment is brought into contact with emulsion ink in the ink fountain 104*a* roughly over the entire length in the width direction of the ink fountain. Also, the ink contacting member 106 is disposed roughly in parallel to the axial line of the ink furnishing roller 103 as in the above-described first embodiment, and is disposed at a position spaced from the ink furnishing roller 103.

Even if the ink contacting member 106 is constructed as in the above-described present embodiment, effects and actions that are similar to those of the above-described first embodiment can be brought about.

In particular, by providing the ink contacting member 106 in which a spiral groove 106*d* inclined with respect to the axial line of the ink furnishing roller 103 is provided on the surface of the roller formed roughly over the entire length in the width direction of the ink fountain 104*a*, it is possible to remarkably improve the convection state of emulsion ink in the ink fountain 104*a*, in particular, the convection state in the width direction of the ink fountain 104*a* as in the above-described first embodiment.

Also, it does not matter that the ink-contacting member 106 is disposed so as to be brought into contact with the ink furnishing roller 103. In other words, the ink contacting member 106 may be disposed in a range where ink rolls are formed, or may be disposed at a position where the convection state of emulsion ink in the ink fountain 104*a* may be varied. However, in view of executing stabilized metering and furnishing of ink, it is preferable that the distance between the ink contacting member 106 and the ink furnishing roller 103 is 1 through 10 mm, and it is further preferable that the distance is 1 through 5 mm. In particular, in this range, such an effect can be brought about, which can supplement defective ink furnishing that becomes a problem in a case of using high viscosity ink in the anilox system.

Embodiment 4

FIG. 10A through FIG. 10F show a fourth embodiment of the ink furnishing apparatus 100 according to the present invention. Also, in the present embodiment, since the fourth embodiment has the same construction as that of the above-described first embodiment, excepting that the construction of the ink contacting member 106 differs from that of the first embodiment, an overlapping description is omitted.

The ink contacting member 106 according to the present embodiment is composed of a single baffle plate formed roughly over the entire length in the width direction of the ink fountain 104*a*. The baffle plate may be like a bar as its figure so far as it is formed roughly over the entire length in the width direction of the ink fountain 104*a*. In addition, as shown in FIG. 10A through FIG. 10F, the sectional shape of the baffle plate is not particularly limited. For example, it may be square, triangular, circular, elliptical, etc.

The ink-contacting member 106 is disposed in the ink fountain 104*a* and is placed and fixed between a pair of end sealing plates 112*a* and 112*b*. Therefore, a part or the entirety of the ink contacting member 106 according to the present embodiment is brought into contact with emulsion ink in the ink fountain 104*a* roughly over the entire length in the width direction of the ink fountain 104*a*. Also, the ink contacting member 106 is disposed roughly in parallel to the axial line of the ink furnishing roller 103 as in the above-described third embodiment, and is disposed at a position spaced from the ink furnishing roller 103.

Even if the ink-contacting member 106 is constructed as in the present embodiment, actions and effects that are similar to those of the above-described first embodiment can be achieved.

Also, if the ink contacting member 106 is composed of a plurality of plate members inclined with respect to the axial line of the ink furnishing roller 103 as in the plate member 106*b* according to the above-described first embodiment, as in the above-described first embodiment, it is possible to remarkably improve the fluidity of emulsion ink in the ink fountain 104*a*, and in particular, the fluidity in the width direction of the ink fountain 104*a*.

In addition, by providing grooves on the surface of the ink-contacting member 106, the convection state of emulsion ink in the ink fountain 104*a* can be improved. Further, by providing diagonal grooves inclined with respect to the axial line of the ink furnishing roller 103 on the surface of the ink contacting member 106, the fluidity particularly in the width direction of the ink fountain 104*a* can be remarkably improved as in the above-described second embodiment.

Further, based on a reason similar to that in the above-described third embodiment, the ink contacting member 106 may be disposed in a state where it is brought into contact with the ink furnishing roller 103. However, in view of carrying out stabilized metering and furnishing of ink, it is preferable that the distance between the ink contacting member 106 and the ink furnishing roller 103 is 1 through 10 mm, and it is further preferable that the distance is 1 through 5 mm.

In the embodiments described above, although a description was given of an ink furnishing apparatus in which ink stored in the ink fountain 104*a* is fed to the ink furnishing roller 103 and ink forming roller 102 and is further fed to a printing plate 101*a*, the present invention may be applicable to other embodiments.

Figure 11:
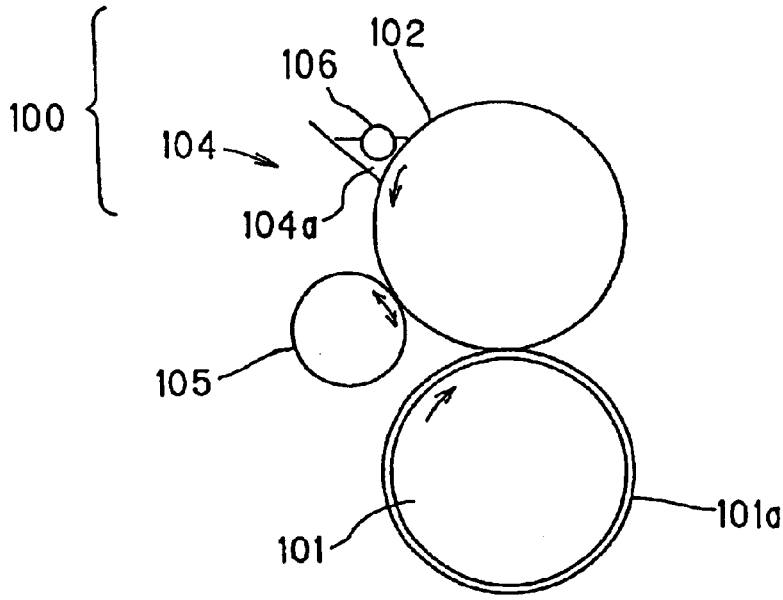
FIG. 11 is a view showing a rough construction of an ink furnishing apparatus according to another embodiment of the present invention.

As one of the other embodiments, FIG. 11 shows an embodiment in which the above-described ink furnishing roller 103 is omitted. The ink furnishing apparatus 120 is provided with an ink forming roller 102 for furnishing ink to a printing plate 101*a* mounted on a plate cylinder 101 of a press, ink metering and furnishing unit 104 for withdrawing (metering) emulsion ink in the ink fountain 104*a* onto the ink forming roller 102 at a roughly predetermined membrane thickness in collaboration with rotations of the above-described ink furnishing roller 102, and a shear control roller 105 for controlling an emulsion state of emulsion ink on the ink forming roller 102 as emulsion breakdown unit, and is further provided with the above-described ink contacting member 106 in the ink fountain 104*a* or upward thereof.

The present invention may be applicable to an embodiment in which a plurality of rollers intervene between the ink furnishing roller 103 and the plate cylinder 101 of a press. In other words, the present invention may be applicable to an ink furnishing apparatus in which a plurality of the ink forming roller 102 are disposed.

Also, in the above-described embodiments, a description was given of a lithographic press using emulsion ink, which does not require any dampening water. Since ink rolls that may occur in the ink fountain adversely influence the printing performance, the present invention is applicable to a lithographic press that does not use emulsion ink. For example, if the present invention is applied to a lithographic press that forms emulsion on the surface of the plate cylinder by furnishing dampening water with typical ink used, and a lithographic press that uses water-free ink (oil-based ink), it is possible to prevent the printing performance from being lowered.

Figure 10A:
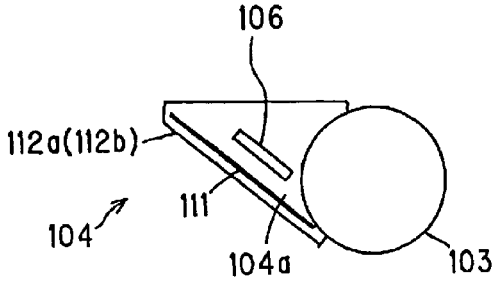
FIGS. 10A to 10G are views showing a fourth embodiment of the ink furnishing apparatus.
Figure 10B:
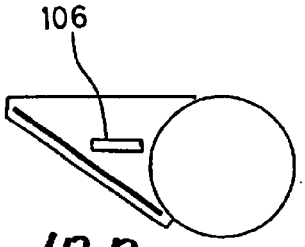
Figure 10C:
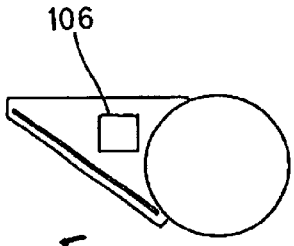
Figure 10D:
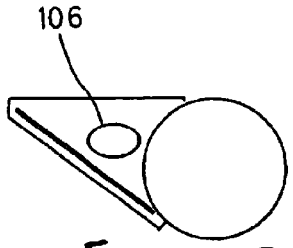
Figure 10E:
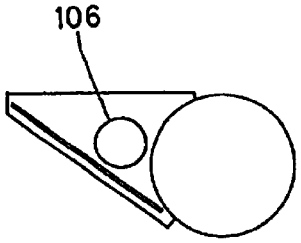
Figure 10F:
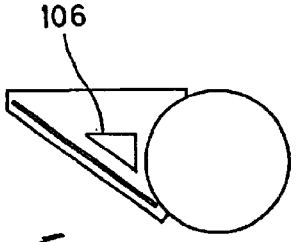
Figure 10G:
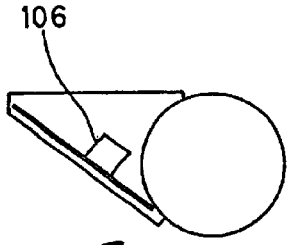

Further, the above-described ink-contacting member 106 may be constructed to be integral with the ink fountain 104*a*. For example, as shown in FIG. 10G, where a projection that functions by the above-described ink contacting member 106 is provided on the blade 111 acting as a bottom plate of the ink fountain 104*a*, actions and effects that are similar to those of the present invention can be brought about.

Further, a description is given of a preferred embodiment of the shear control roller.

Figure 12:
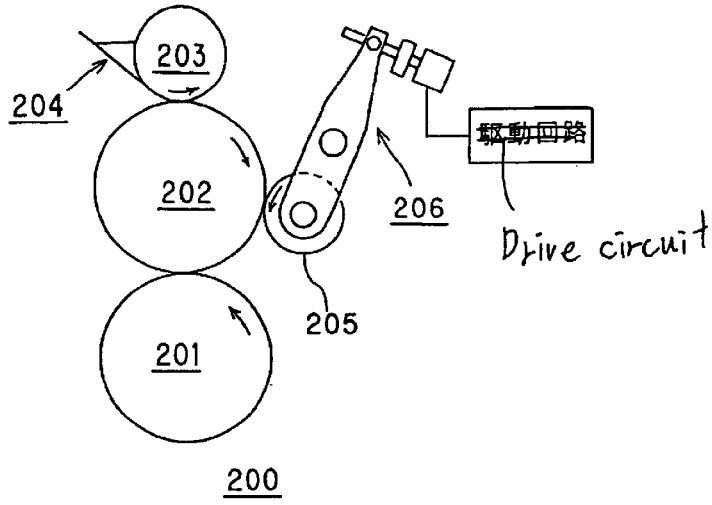
FIG. 12 is a view showing a first construction of an ink furnishing apparatus in which a shearing force is controllable.
Figure 13:
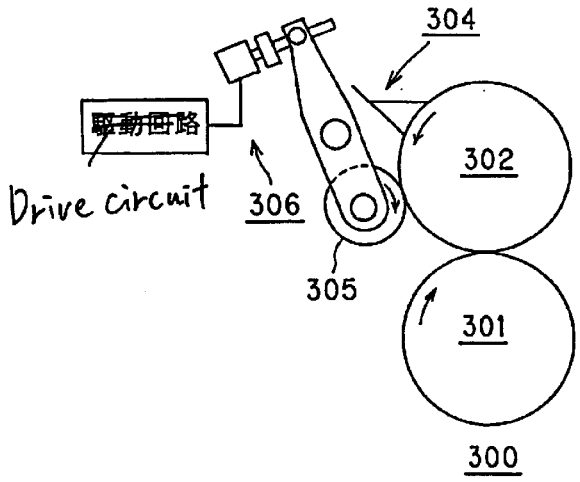
FIG. 13 is a view showing a second construction of an ink furnishing apparatus in which a shearing force is controllable.
Figure 14:
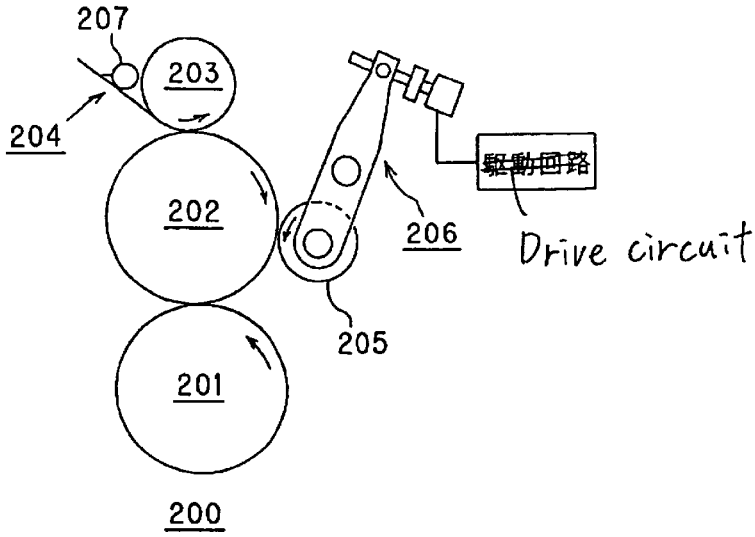
FIG. 14 is a view showing a construction of an ink furnishing apparatus provided with ink agitating unit.

FIG. 12 shows a first construction of an ink furnishing apparatus capable of controlling shear. FIG. 13 shows a second construction thereof. In FIG. 12, an ink furnishing apparatus 200 is provided with an ink forming roller 202 for furnishing emulsion ink to a plate cylinder 201, an ink furnishing roller 203 for furnishing emulsion ink to the ink forming roller 202, ink metering and furnishing unit 204 for withdrawing a predetermined membrane thickness of emulsion ink from the ink fountain in collaboration with the ink furnishing roller 203 and forming the same on the surface of the ink furnishing roller 203, a shear control roller 205, which is brought into contact with the ink forming roller 202 and applies shear (a shearing force) to emulsion ink, and nip pressure controlling unit 206 for controlling the nip pressure at a contact point between the ink forming roller 202 and the shear controlling roller 205 during operation. Also, ink agitating unit 207 may be provided therein, which agitates emulsion ink stored in the ink fountain and causes the same to flow (See FIG. 14).

Figure 15:
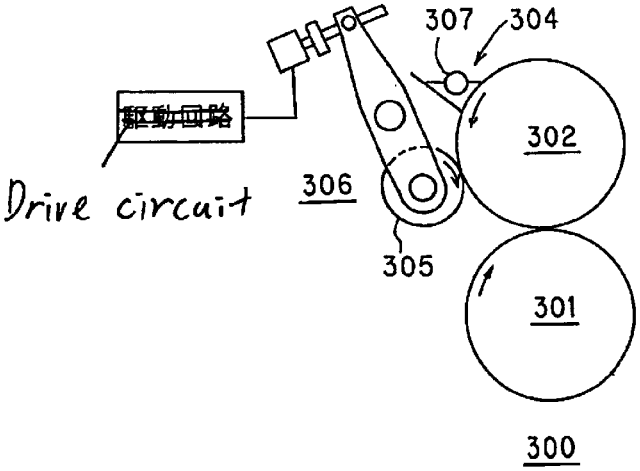
FIG. 15 is a view showing a construction of an ink furnishing apparatus provided with ink agitating unit.

In addition, in FIG. 13, an ink furnishing apparatus 300 is provided with an ink forming roller 302 for furnishing emulsion ink to a plate cylinder 301, ink metering and furnishing unit 304 for withdrawing a predetermined membrane thickness of emulsion ink from the ink fountain in collaboration with the ink forming roller 302 and forming the same on the surface of the ink forming roller 302, a shear controlling roller 305, which is brought into contact with the ink forming roller 302 and applies shear (a shearing force) to the emulsion ink, and nip pressure controlling unit 306 for controlling the nip pressure at a contact point between the ink forming roller 302 and the shear controlling roller 305. Also, ink agitating unit 307 maybe provided therein, which agitates emulsion ink stored in the ink fountain and causes the same to flow (See FIG. 15).

Figure 16:
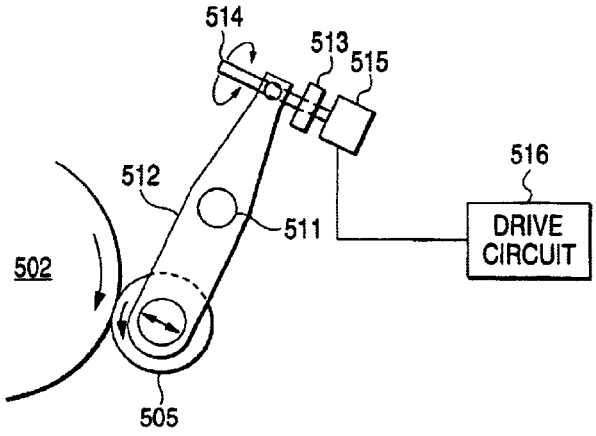
FIG. 16 is a view showing a first construction of nip pressure controlling unit.

FIG. 16 shows a first construction of the nip pressure controlling unit 206 and 306, wherein the construction is provided with an arm 512, which supports the shear controlling roller 505 brought into contact with the ink forming roller 502 at its one end and whose support axis 511 is fixed at the frame of a press (not illustrated), a threaded shaft 514 which is screwed in the other end of the arm 512 and is rotatably fitted to a threaded shaft receiver 513 fixed on the frame of a press (not illustrated), a motor 515 for causing the threaded shaft 514 to rotate clockwise and counterclockwise, and a drive circuit 516 for driving the motor 515.

The above-described nip pressure controlling unit controls the nip pressure by rocking the arm centering around the support point by normal or reverse turning of the threaded shaft and by moving the shear controlling roller in the direction along which the shear controlling roller is brought into contact with the ink forming roller or in the direction along which the same is separated therefrom. The movement amount of the shear-controlling roller during printing is controlled by fine drive of the motor so that the shear-controlling roller is brought into contact with the ink forming roller at a nip pressure necessary to keep emulsion breakdown constant. In order to accurately control the movement amount of the shear-controlling roller, it is preferable that a motor, which is able to accurately control its position, such as a servomotor, a stepping motor, etc., is used. Also, where ink furnishing is stopped in response to a stop of the operation, the shear-controlling roller is immediately separated from the ink forming roller by driving the motor at a high speed.

Figure 17:
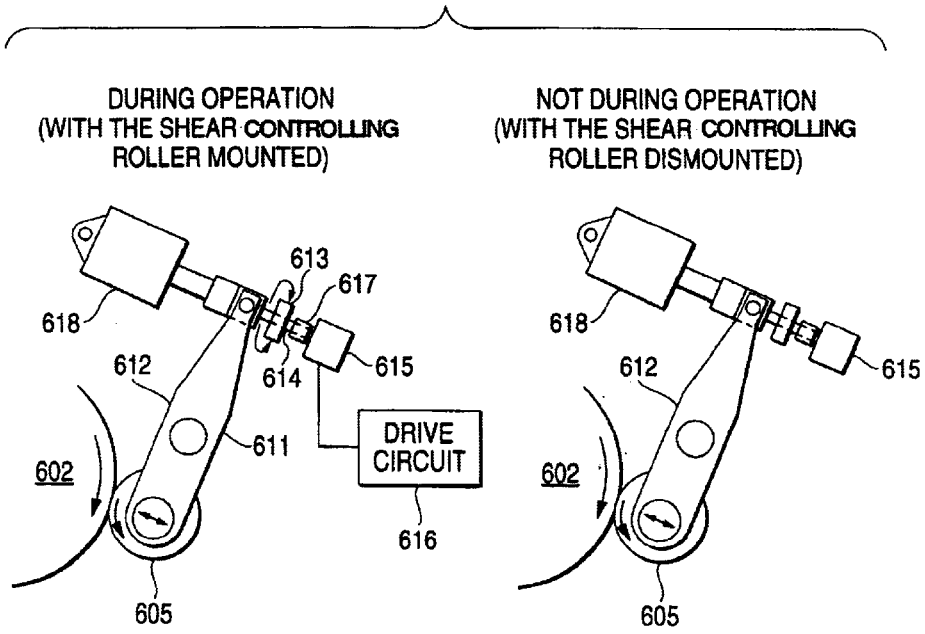
FIG. 17 are views showing a second construction of nip pressure controlling unit.

FIG. 17 shows a second construction of the nip pressure controlling unit 206 and 306. The second construction is provided with an arm 612, which supports the shear controlling roller 605 brought into contact with the ink forming roller 602 at its one end and whose support axis 611 is fixed at a frame of a press (not illustrated), a threaded shaft 614 that is screwed with the other end of the arm 612 and is rotatably fitted to the threaded shaft receiver 613 fixed at the frame of a press (not illustrated), a motor 615 for rotating the threaded shaft 614 clockwise and counterclockwise via a coupling 617 freely moving in the thrust direction, a drive circuit 616 for driving the motor 615, and an air cylinder 618 for moving the other end of the arm 612 in the thrust direction.

The nip pressure controlling unit constructed as described above controls the nip pressure by rocking the arm centering around the support point by normal or reverse turning of the threaded shaft and by moving the shear controlling roller in the direction along which the shear controlling roller is brought into contact with the ink forming roller or in the direction along which the same is separated therefrom. The movement amount of the shear-controlling roller during printing is controlled by fine drive of the motor so that the shear-controlling roller is brought into contact with the ink forming roller at a nip pressure necessary to keep emulsion breakdown constant. In order to accurately control the movement amount of the shear-controlling roller, it is preferable that a motor, which is able to accurately control its position, such as a servomotor, a stepping motor, etc., is used. Also, where ink furnishing is stopped in response to a stop of the operation, the shear-controlling roller is immediately separated from the ink forming roller by actuating the air cylinder.

Figure 18:
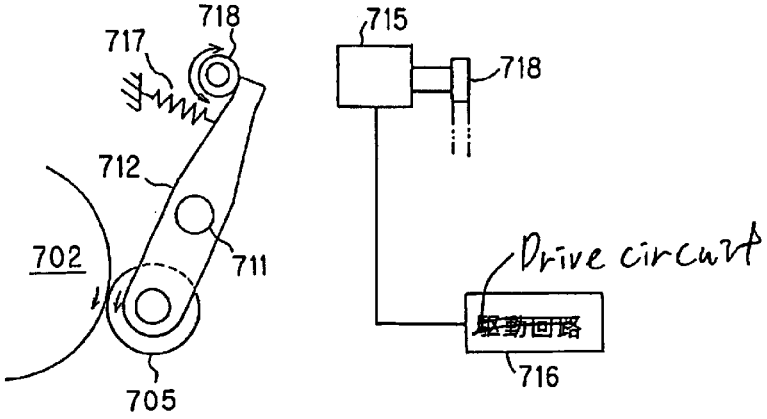
FIG. 18 are views showing a third construction of the nip pressure controlling unit.

FIG. 18 shows a third construction of the nip pressure controlling unit 206 and 306. The third construction is provided with an arm 712 which supports a shear controlling roller 705 brought into contact with the ink forming roller 702 at its one end and whose support axis 711 is fixed on a frame of a press (not illustrated), an eccentric cam 718 brought into contact with the other end of the arm 712, a tension spring 717 that always presses the arm 712 to the eccentric cam 718,a motor 715 for turning the eccentric cam 718 clockwise and counterclockwise, and a drive circuit 716 for driving the motor 715.

The nip pressure controlling unit constructed as described above controls the nip pressure by rocking the arm centering around the support point by normal or reverse turning of the eccentric cam and by moving the shear controlling roller in the direction along which the shear controlling roller is brought into contact with the ink forming roller or in the direction along which the same is separated therefrom. The movement amount of the shear-controlling roller during printing is controlled by fine drive of the motor so that the shear-controlling roller is brought into contact with the ink forming roller at a nip pressure necessary to keep emulsion breakdown constant. In order to accurately control the movement amount of the shear-controlling roller, it is preferable that a motor, which is able to accurately control its position, such as a servomotor, a stepping motor, etc., is used. Also, where ink furnishing is stopped in response to a stop of the operation, the shear-controlling roller is immediately separated from the ink forming roller by turning the eccentric cam by 180 degrees by driving the motor at a high speed.

Figure 19:
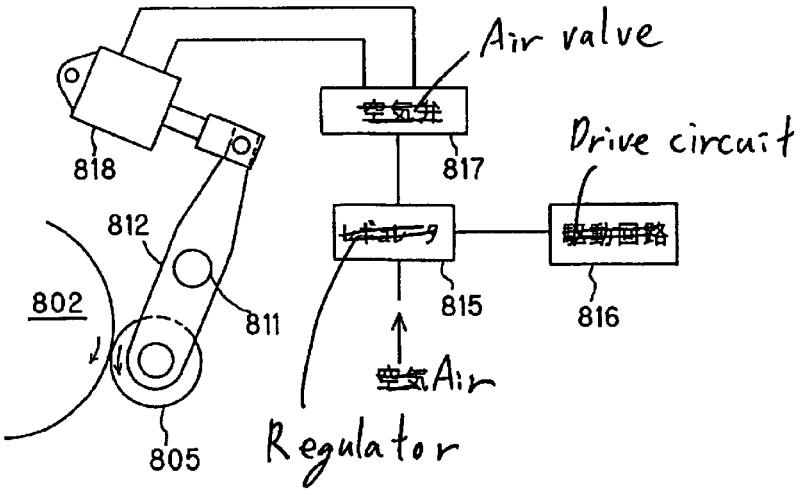
FIG. 19 is a view showing a fourth construction of the nip pressure controlling unit.
Figure 20:
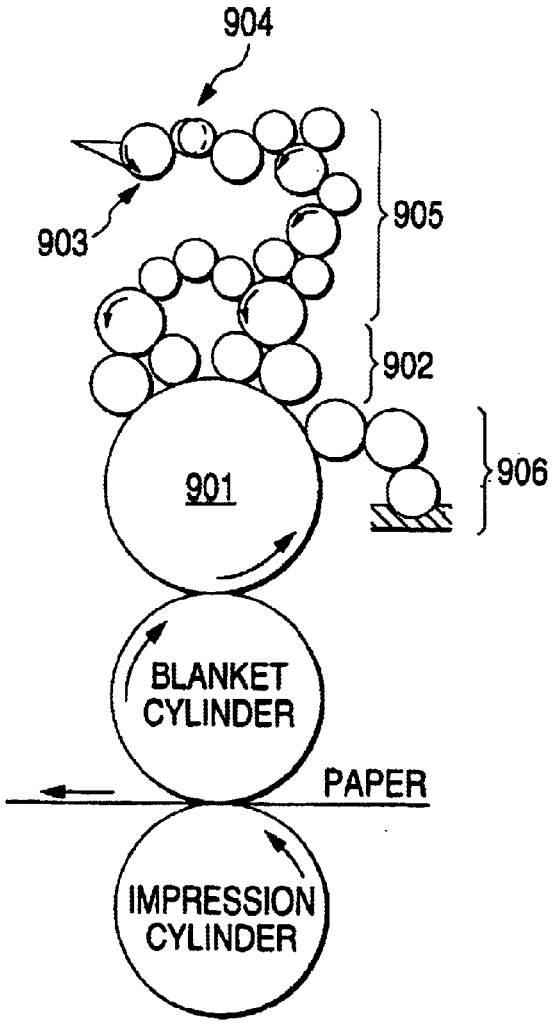
FIG. 20 PRIOR ART
FIG. 20 is a view showing a rough construction of the ink furnishing apparatus of a prior art lithographic press.
Figure 21:
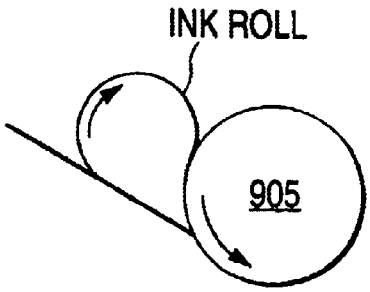
FIG. 21 is a view showing an ink roll which may be formed in the ink fountain.

FIG. 19 shows a fourth construction of the nip pressure controlling unit 206 and 306. The fourth construction is provided with an arm 812 which supports the shear controlling roller 805 brought into contact with the ink forming roller 802 at its one end and whose support axis 811 is fixed on a frame of a press (not illustrated), an air cylinder 818 for moving the arm 812 to the other end thereof, an air valve 817 for changing the flow of air with respect to the air cylinder 818, an electricity/air regulator 815 for adjusting the pneumatic pressure of the air cylinder 818, and a drive circuit 816 for driving the electricity/air regulator 815.

The nip pressure controlling unit constructed as described above controls the nip pressure by varying the force in the direction of bringing the shear controlling roller into contact with the ink forming roller centering around the support point of the arm by changing the pneumatic pressure of the air cylinder in the forward direction (in the direction of the arrow in the drawing) by the electricity/air regulator. The movement amount of the shear controlling roller during printing is controlled by varying the pneumatic pressure of the air cylinder so that the shear controlling roller is brought into contact with the ink forming roller at a nip pressure necessary to keep emulsion breakdown constant. Contacting and separation of the shear-controlling roller with respect to the ink forming roller are carried out by changing over the air valve.

In the ink furnishing apparatus described above, it is preferable that cooling unit is provided in order to suppress a slight temperature rise by controlling the nip pressure. Various methods may be employed as a cooling unit, for example, a type in which cooling water is circulated into the shear controlling roller or a type in which cooling air is circulated in the shear controlling roller and ink forming roller.

Still further, in order to efficiently furnish an ink constituent and a water constituent, which are separated from each other through emulsion breakdown, to the plate cylinder, it is preferable that the contact position between the above-described shear controlling roller and the ink furnishing roller is located at the upstream side in the rotation direction of the above-described ink furnishing roller from the contact point between the above-described ink furnishing roller and the plate cylinder. In addition, it is further preferable that the former contact point is drawn near to the contact point between the above-described ink furnishing roller and the plate cylinder.

In order to prevent printing hindrances such as stains, stepwise unevenness, shortage of print resistance, etc., which may be brought about by slipping of the ink furnishing roller , it is necessary that the ink furnishing roller rotates at the same peripheral speed as that of the plate cylinder. Also, since the ink furnishing roller varies its rotation speed due to influences in slipping which may occur between the ink furnishing roller and the shear controlling roller described later, it is necessary to control the ink furnishing roller so that no slip is permitted to occur between the same and the plate cylinder, taking a change in speed into consideration. It is preferable that, in order to prevent a difference (ghost) in ink density due to unevenness of ink transfer onto the plate cylinder from occurring, the diameter of the ink furnishing roller is made the same as that of the plate cylinder. However, it is not necessary to make the diameter of the ink furnishing roller strictly identical to that of the plate cylinder, wherein since it is confirmed that, if a difference in diameter between the ink furnishing roller and the plate cylinder is in a range of approx. ±1 mm, performance of preventing a ghost from occurring does not deteriorate, wherein it is preferable that the diameter of the ink furnishing roller is set to be larger by approx. 1 mm than that of the plate cylinder with wear due to usage taken into consideration.

As described above, according to the present invention, since an ink roll can be suppressed or prevented from occurring by the ink agitating unit provided in the ink fountain, and fluidity and agitation performance of ink in the ink fountain can be secured, it becomes possible to satisfactorily measure ink and furnish the same to the ink furnishing roller.

What is claimed is:

1. An ink furnishing apparatus comprising:

an ink fountain storing ink;

an ink furnishing roller engaged with the ink fountain, withdrawing the ink the ink fountain by rotations thereof and furnishing the ink for a printing plate;

an ink contacting member formed at substantially an entire length of the ink fountain in a width direction thereof and contactable with the ink in the ink fountain, and a driving unit operable to adjust a contact position of ink contacting member with the ink in the ink fountain in response to at least one of an amount of the ink in the ink fountain and a convection state of the ink in the ink fountain.

2. The ink furnishing apparatus as set forth in claim 1, wherein the ink contacting member is disposed to be spaced from the ink furnishing roller.

3. The ink furnishing apparatus as set forth in claim 1, wherein the ink contacting member is disposed substantially in parallel to an axial line of the ink furnishing roller.

4. The ink furnishing apparatus as set forth in claim 1, wherein the ink contacting member is divided into a plurality of sections along the width direction of the ink fountain, or includes a plurality of molded members juxtaposed along the width direction of the ink fountain.

5. The ink furnishing apparatus as set forth in claim 1, wherein a portion of the ink contacting member contacting with the ink is inclined with respect to an axial line of the ink furnishing roller.

6. The ink furnishing apparatus as set forth in claim 1, wherein the ink contacting member includes a baffle plate.

7. A printing machine with the ink furnishing apparatus as set forth in claim 1.

8. The ink-furnishing apparatus as set forth in claim 1, wherein the ink is emulsion ink.

9. The ink-furnishing apparatus as set forth in claim 8, further comprising:

an ink forming roller contacting with the printing plate and furnishing the emulsion ink to the printing plate;

a shear controlling roller contacting with the ink forming roller and bringing about emulsion breakage by applying shear to the emulsion ink; and a nip pressure controlling unit controlling a nip pressure at a contact point between the shear controlling roller and the ink forming roller during operation.

10. The ink-furnishing apparatus as set forth in claim 9, further comprising:

an ink furnishing unit withdrawing the emulsion ink with a predetermined membrane thickness from the ink fountain in cooperation with the ink forming roller and forming the emulsion ink on the surface of the ink forming roller, and wherein the ink furnishing roller furnishes the emulsion ink to the ink forming roller.

11. The ink furnishing apparatus as set forth in claim 1, wherein a surface of the ink contacting member defines grooves thereon.

12. The ink furnishing apparatus as set forth in claim 1, wherein a surface of the ink contacting member defines inclined grooves thereon with respect to the axial line of the ink furnishing roller.

13. The ink-furnishing apparatus as set forth in claim 9, further comprising an ink furnishing unit withdrawing the emulsion ink with a predetermined membrane thickness from the ink fountain in cooperation with the ink forming roller and forming the emulsion ink on the surface of the ink forming roller.

14. An ink-furnishing apparatus comprising:

an ink fountain storing emulsion ink therein;

an ink forming roller contacting with a printing plate and furnishing the emulsion ink to the printing plate;

a shear controlling roller contacting with the ink furnishing roller and bringing about emulsion breakage by applying shear to the emulsion ink; and a nip pressure controlling unit controllable a nip pressure at a contact point between the shear controlling roller and the ink forming roller during operation.

15. The ink-furnishing apparatus as set forth in claim 14, further comprising:

an ink furnishing roller furnishing the emulsion ink to the 1ink forming roller; and an ink furnishing unit withdrawing the emulsion ink with a predetermined membrane thickness from the ink fountain in cooperation with the ink furnishing roller and forming the emulsion ink on the surface of the ink furnishing roller.

16. The ink-furnishing apparatus as set forth in claim 14, further comprising an ink furnishing unit withdrawing the emulsion ink with a predetermined membrane thickness from the ink fountain in cooperation with the ink forming roller and forming the emulsion ink on the surface of the ink forming roller.

17. A printing method comprising:

furnishing emulsion ink stored in an ink fountain to an ink forming roller contacting with a printing plate of an offset press;

contacting a shear controlling roller onto the emulsion ink on the ink forming roller;

controlling a nip pressure at a contact point between the ink forming roller and the shear controlling roller;

applying a shear to the emulsion ink by the shear controlling roller, the shear bringing about emulsion breakage at the contact point; and furnishing emulsion ink on the ink forming roller to the printing plate while maintaining appointed emulsion breakage of the emulsion ink.

18. The ink furnishing apparatus as set forth in claim 1, wherein the ink contacting member includes a roller.

19. An ink furnishing apparatus comprising:

an ink fountain storing ink;

an ink furnishing roller engaged with the ink fountain, withdrawing the ink in the ink fountain by rotations thereof and furnishing the ink for a printing plate; and an ink contacting member formed at substantially an entire length of the ink fountain in a width direction thereof and contactable with the ink in the ink fountain, wherein a portion of the ink contacting member contacting with the ink is inclined with respect to an axial line of the ink furnishing roller.

20. The ink furnishing apparatus as set forth in claim 19, wherein the ink contacting member includes at least one contacting unit and the contacting unit is inclined with respect to the axial line of the ink furnishing roller.

* * * * *